US008246209B2

(12) United States Patent
Lai

(10) Patent No.: US 8,246,209 B2
(45) Date of Patent: Aug. 21, 2012

(54) ILLUMINATION DEVICE

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 403 days.

(21) Appl. No.: 12/648,001

(22) Filed: Dec. 28, 2009

(65) Prior Publication Data

US 2010/0296309 A1 Nov. 25, 2010

(30) Foreign Application Priority Data

May 20, 2009 (CN) ..... 2009 1 0302484

(51) Int. Cl.
*F21V 21/26* (2006.01)

(52) U.S. Cl. ..... 362/269; 362/280; 362/281; 362/282; 362/283; 362/284

(58) Field of Classification Search ..... 362/269, 362/280–284, 319, 322–324
See application file for complete search history.

(56) References Cited

U.S. PATENT DOCUMENTS

| | | | | |
|---|---|---|---|---|
| 4,575,786 | A * | 3/1986 | Roberts | 362/279 |
| 8,100,552 | B2 * | 1/2012 | Spero | 362/231 |
| 2007/0019408 | A1 | 1/2007 | McGuire, Jr. et al. | |
| 2008/0029720 | A1 | 2/2008 | Li | |
| 2010/0157571 | A1 * | 6/2010 | Lai | 362/84 |

FOREIGN PATENT DOCUMENTS

TW 200907397 A 2/2009

* cited by examiner

*Primary Examiner* — Stephen F Husar
*Assistant Examiner* — James Cranson, Jr.
(74) *Attorney, Agent, or Firm* — Altis Law Group, Inc.

(57) ABSTRACT

An exemplary illumination device includes a light source and a light-pervious light guiding barrel. The light source is configured for emitting light along a given light path. The light-pervious light guiding barrel receives the light source therein, and the barrel includes light guiding regions with different light directing and/or reflecting capabilities. In addition, the barrel is rotatable relative to the light source such that each of the light guiding regions can be selectively placed on the light path to direct and/or reflect the light from the light source.

17 Claims, 15 Drawing Sheets

ILLUMINATION DEVICE

BACKGROUND

1. Technical Field

The disclosure generally relates to illumination devices, and particularly to an illumination device with adjustable light radiation direction and/or light radiation angle.

2. Description of Related Art

Nowadays, light emitting diodes (LEDs) have been used extensively as light sources for illumination devices due to their high luminous efficiency, low power consumption and long lifespan. FIG. 15 is a diagram illustrating a Lambertian light intensity distribution of a conventional LED. The Full Width at Half Maximum (FWHM) of the LED is in a range from about 0 degrees to about 60 degrees, and also in a range from about 300 degrees to about 360 degrees. That is, the FWHM of the LED is about 120 degrees. The LED is used to provide light with unchangeable light intensity distribution, which may diminish the LED in many applications.

Therefore, what is needed is an illumination device that overcomes the described limitations.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Reference will now be made to the drawings to describe various embodiments of the illumination device, in detail.

Figure 1:
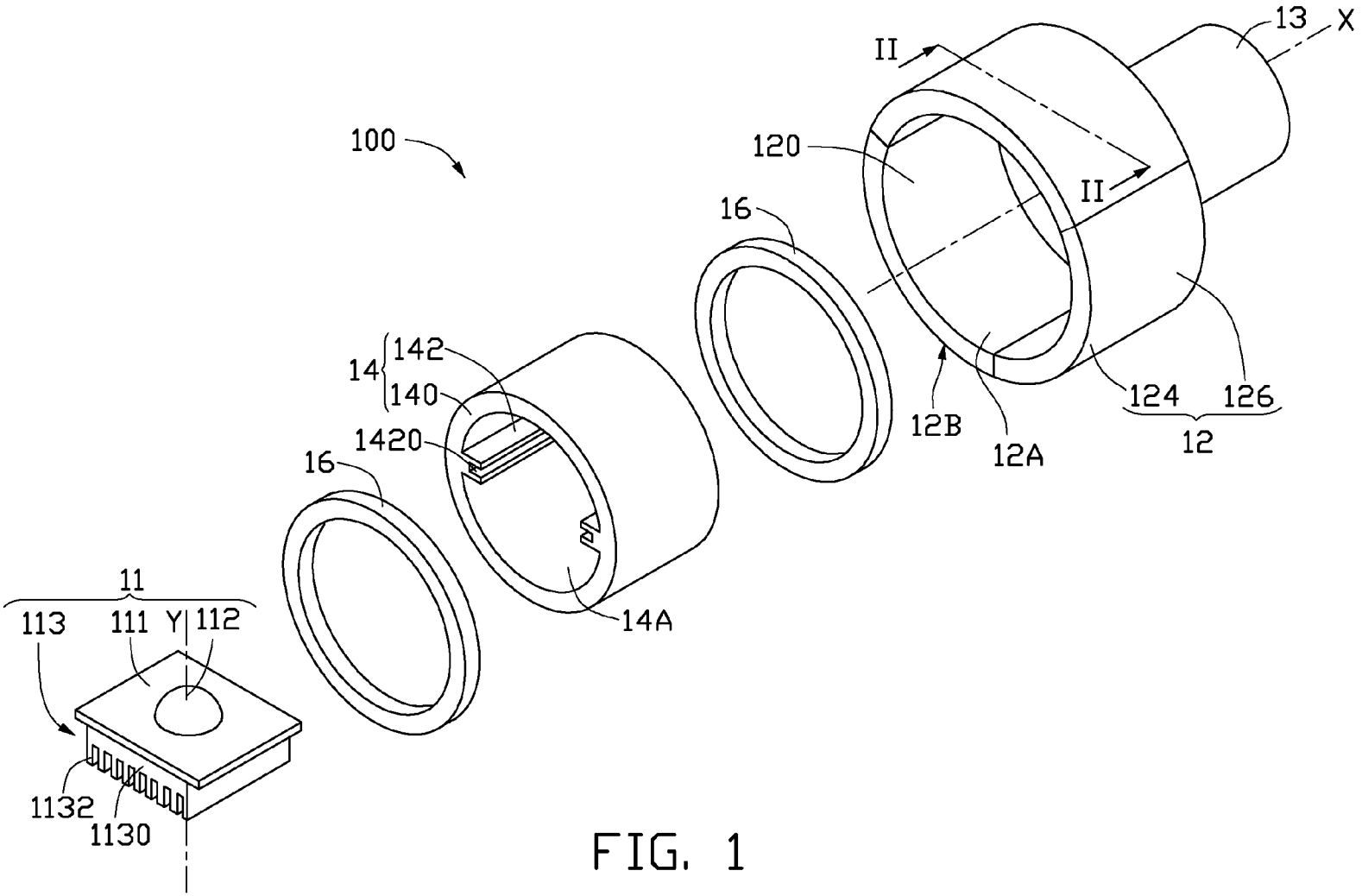
FIG. 1 is a schematic, exploded view of an illumination device, according to an exemplary embodiment.

Referring to FIG. 1, an illumination device 100, according to a first embodiment, includes a light source 11 and a light guiding barrel 12 arranged around the light source 11. The illumination device 100 may further include an actuator 13 for rotating the light guiding barrel 12 or the light source 11.

Figure 15:
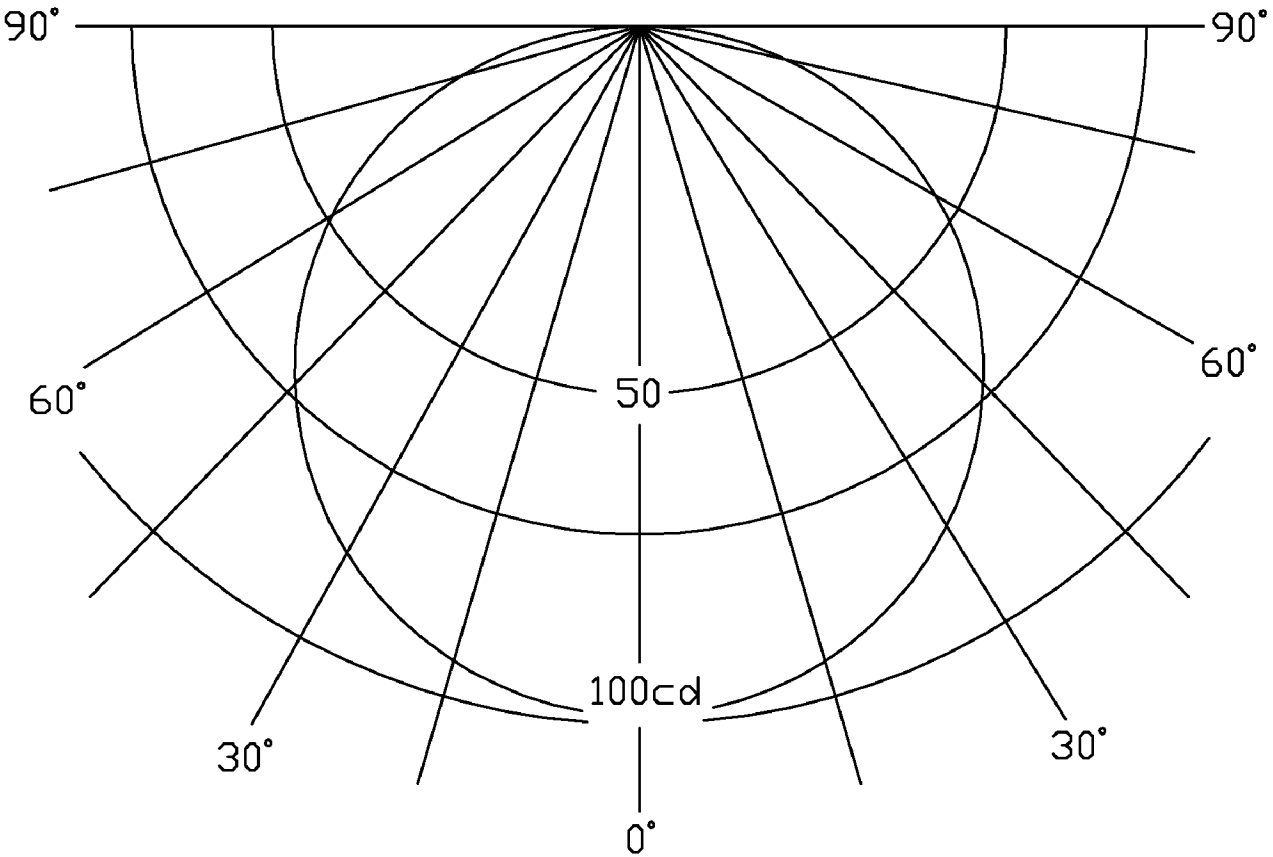
FIG. 15 is a diagram illustrating light intensity distribution of a conventional LED.

The light source 11 includes a substrate 111, and at least one solid-state light source 112 arranged on the substrate 111. In the first embodiment, the solid-state light source 112 is an LED 112 providing a Lambertian light intensity distribution, as shown in FIG. 15. The Full Width at Half Maximum (FWHM) of the LED 112 is in a range from about 0 degrees to about 60 degrees, and also in a range from about 300 degrees to about 360 degrees. That is, the FWHM of the LED 112 is about 120 degrees. A Y-central axis of The LED 112 passes through the substrate 111. The substrate 111 can be a circuit board securing the LED 112. Heat generated by the LED 112 can be absorbed by the substrate 111, and then dissipated to ambient air. The light source 11 may further include a heat dissipation device 113. The heat dissipation device 113 can, for example, include a base 1130 that contacts a side of the substrate 111 away from the LED 112, and a plurality of heat dissipation fins 1132 extending from the base 1130.

Figure 2:
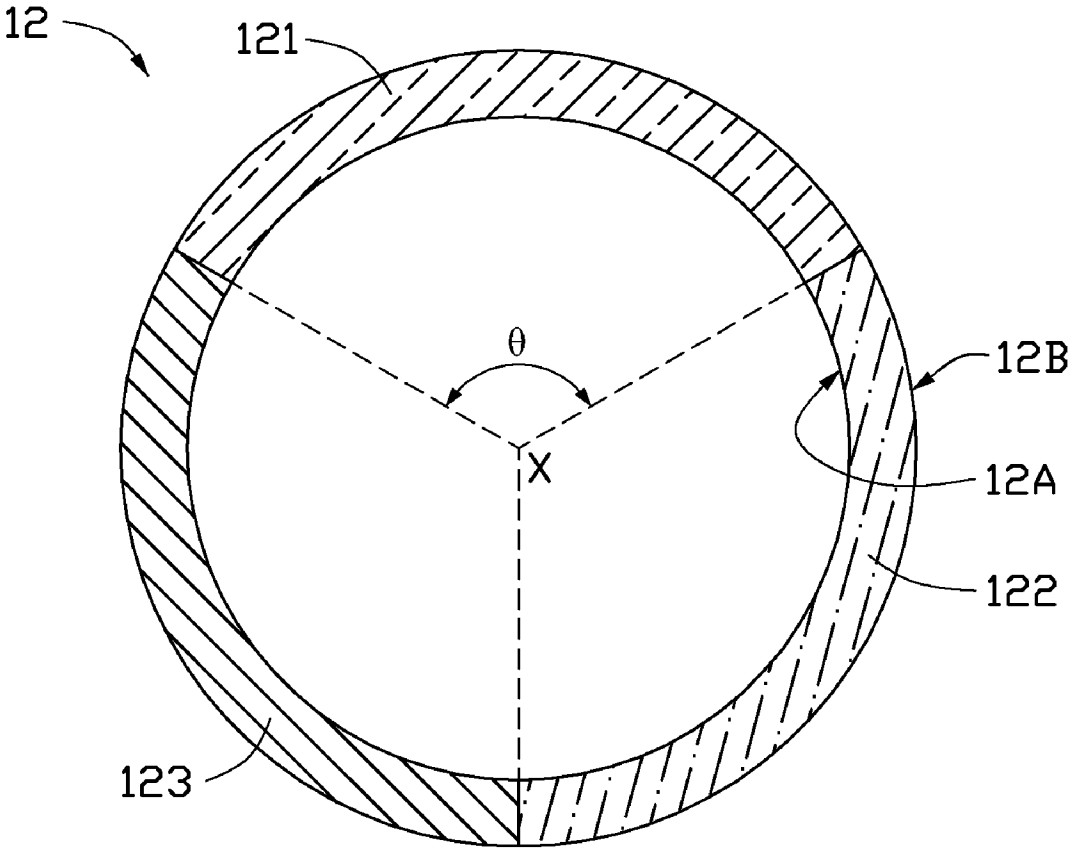
FIG. 2 is an enlarged cross section of a light guiding barrel of the illumination device of FIG. 1, taken from line II-II thereof.

The light guiding barrel 12 can be made of resin, silicone, epoxy, polyethylene terephalate, polymethyl methacrylate, and polycarbonate. Alternatively, the light guiding barrel 12 can be made of glass, or other suitable materials. Referring also to FIG. 2, the light guiding barrel 12 includes a plurality of light guiding regions, for example, a first region 121, a second region 122, and a third region 123. The light guiding regions 121, 122, 123 are sequentially arranged around an X-axis of the light guiding barrel 12 to cooperatively form a first accommodating space 120 for receiving the light source 11. In this embodiment, the light guiding barrel 12 is a substantially cylinder defining the first accommodating space 120 therein. A first end 124 and a second end 126 are at opposite sides of the light guiding barrel 12. The first end 124 is open, with the first accommodating space 120 being exposed to an exterior of the light guiding barrel 12 thereat. The second end 126 is closed. Each of the first, second, and third regions 121, 122, 123 spans through an entire axial length of the light guiding barrel 12 including both the first end 124 and the second end 126. That is, a boundary between every adjacent the light guiding regions 121, 122, and 123 is substantially parallel to the X-axis of the light guiding barrel 12. A transverse cross section of each region 121, 122, 123 (e.g., the first region 121) is part of an annulus. Said part of an annulus subtends a central angle θ, as shown in FIG. 2. The central angle θ may be equal to a viewing angle of the LED 112. For example, if the LED 112 has a viewing angle of 120 degrees, the light guiding barrel 12 can be divided into three regions (i.e., the first, second, and third regions 121, 122, 123), with each part of the annulus subtending the same central angle θ in the amount of 120 degrees.

Figure 3:
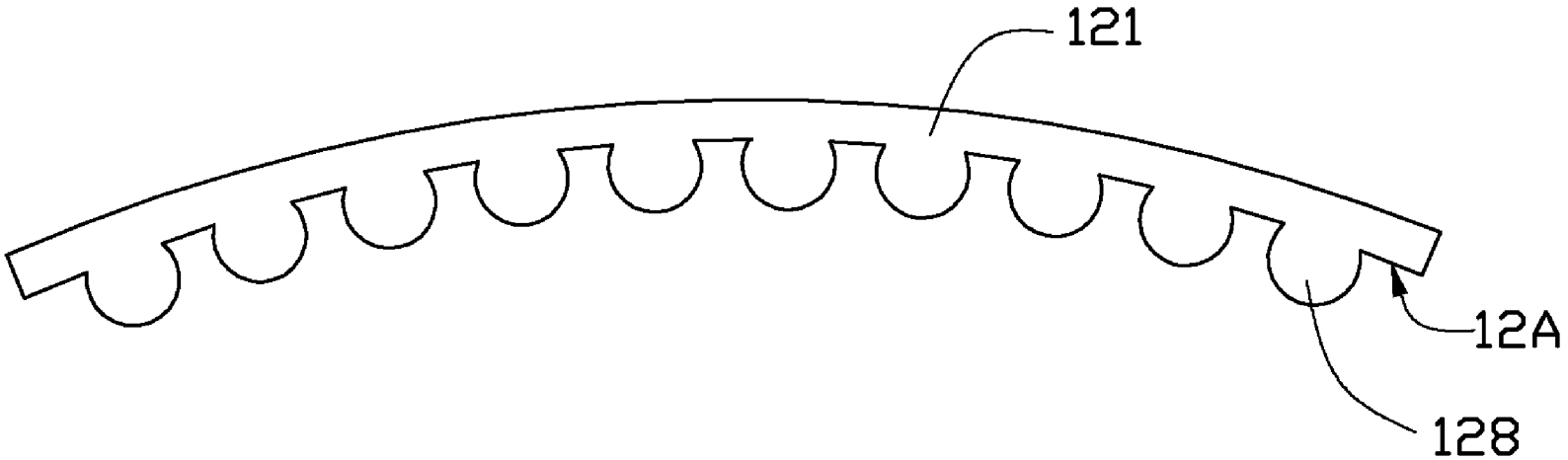
FIG. 3 is a partial and enlarged cross section of a first light guiding region of the light guiding barrel of FIG. 2, the first light guiding region having cylindrical elongated protrusions extending from an interior surface thereof.
Figure 4:
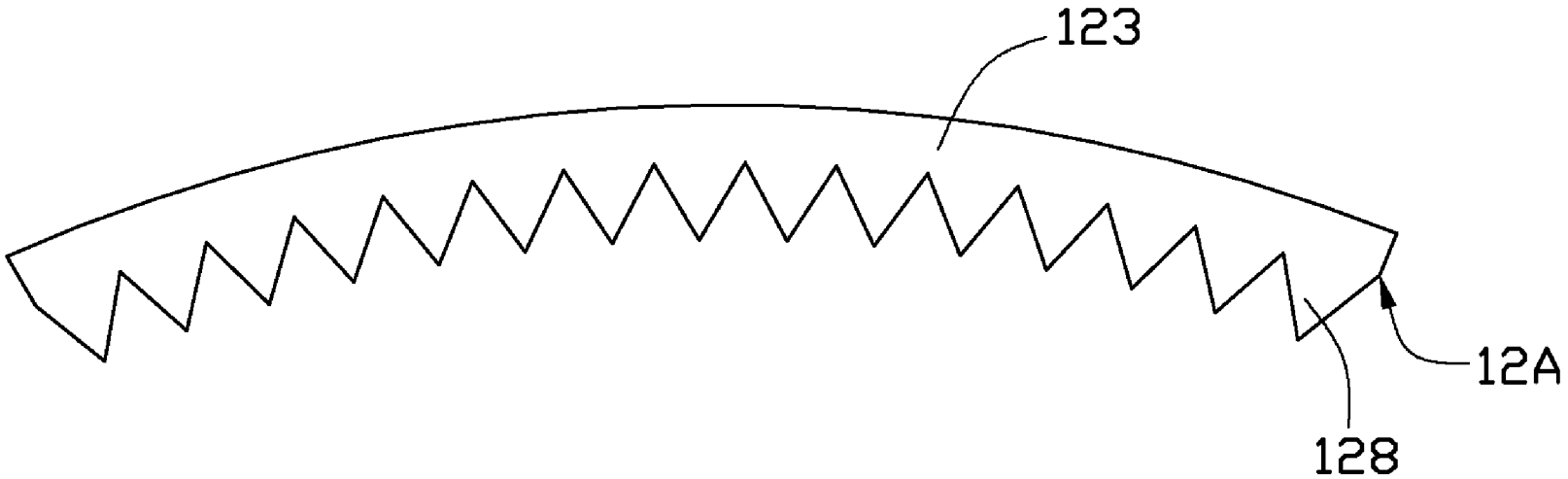
FIG. 4 is a partial and enlarged cross section of a third light guiding region of the light guiding barrel of FIG. 2, the third light guiding region having V-shape elongated protrusions extending from an interior surface thereof, and a transverse cross-section of each V-shape elongated protrusion being an isoceles triangle.
Figure 5:
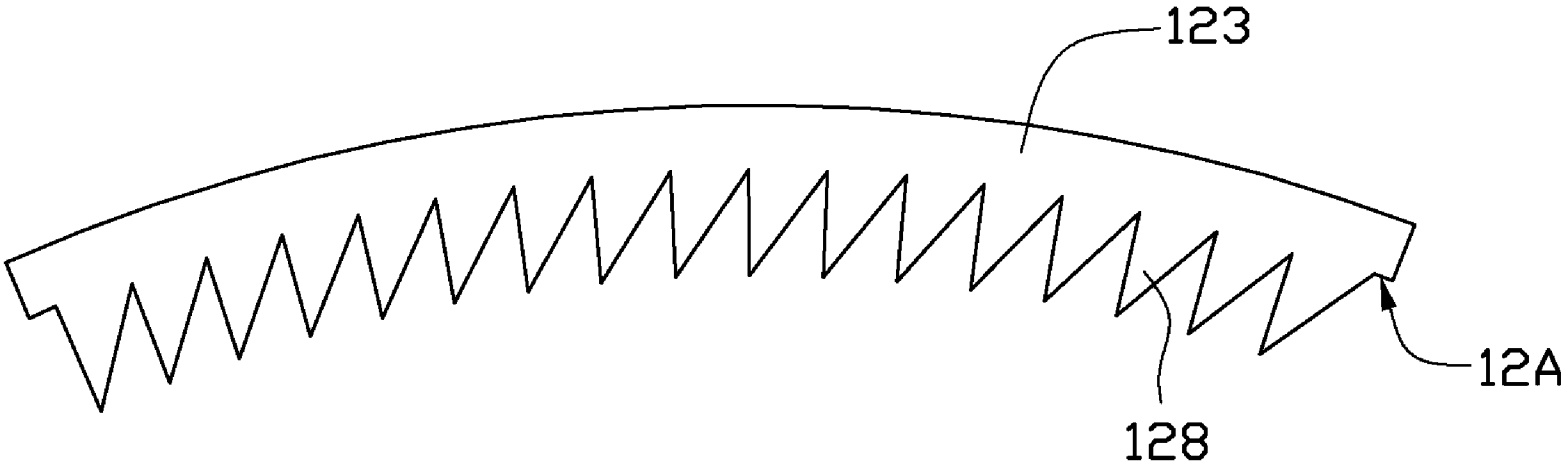
FIG. 5 is similar to FIG. 4, but showing the transverse cross-section of each V-shape elongated protrusion being a right triangle.

The light guiding barrel 12 includes an interior surface 12A and an exterior surface 12B. Each of the first, second, and third regions 121, 122, 123 includes a part of the interior surface 12A and a part of the exterior surface 12B. The light guiding barrel 12 defines a plurality of micro-structures 128 thereon. In this embodiment, the first region 121 has a plurality of cylindrical elongated protrusion 128 extending outwardly from the interior surface 12A thereof along the X-axis, and the exterior surface 12B of the first region 121 is a smooth surface, as shown in FIG. 3. In addition, each of the interior surface 12A and the exterior surface 12B of the second region 122 is a smooth surface. Furthermore, the third region 123 has a plurality of V-shape elongated protrusion 128 extends outwardly from the interior surface 12A thereof, and the exterior surface 12B of the second region 123 is a smooth surface, as shown in FIG. 4. The V-shape elongated protrusions 128 are evenly distributed on the interior surface 12A of the third region 123, and each of the V-shape elongated protrusion 128 extends parallel to the X-axis. In one example, a transverse cross section of each V-shape elongated protrusion 128 is an isoceles triangle, as shown in FIG. 4. In another example, a transverse cross section of each V-shape elongated protrusion 128 can be a right triangle, as shown in FIG. 5.

Figure 6:
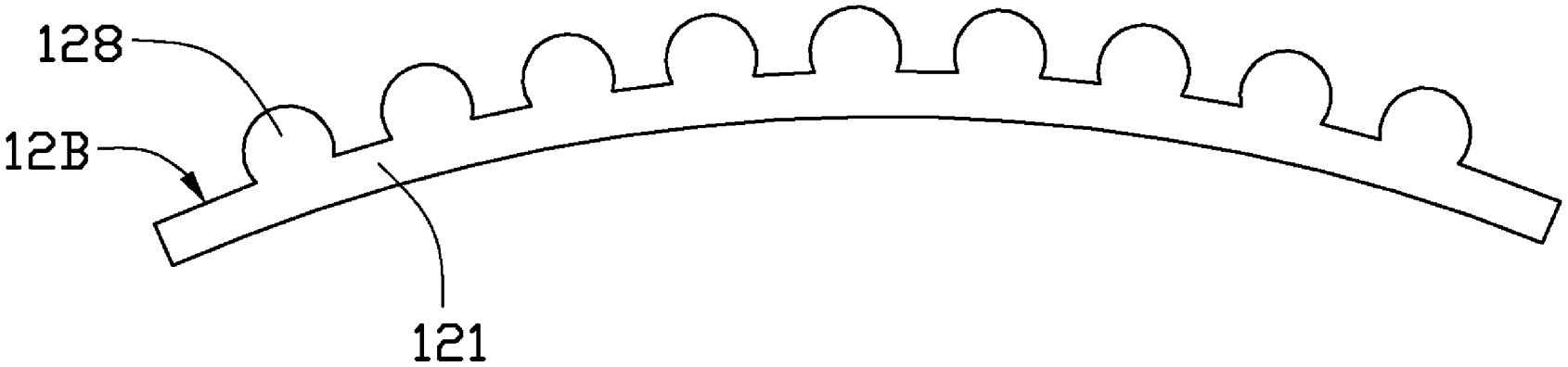
FIG. 6 is similar to FIG. 3, but showing the first light guiding region having cylindrical elongated protrusions extending from an exterior surface thereof.
Figure 7:
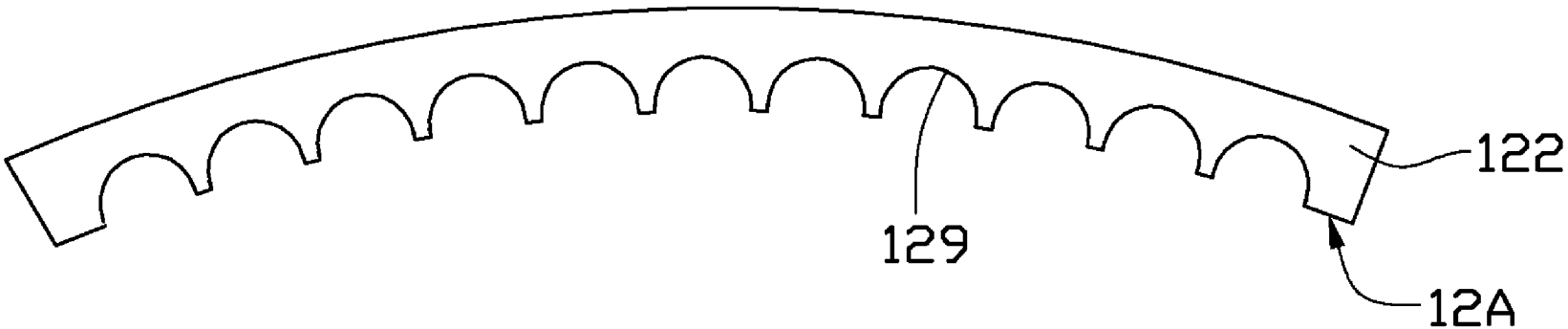
FIG. 7 is a partial and enlarged cross section of a second light guiding region of the light guiding barrel of FIG. 2, the second light guiding region having hemicycle-shaped elongated grooves defined in an interior surface thereof.
Figure 8:
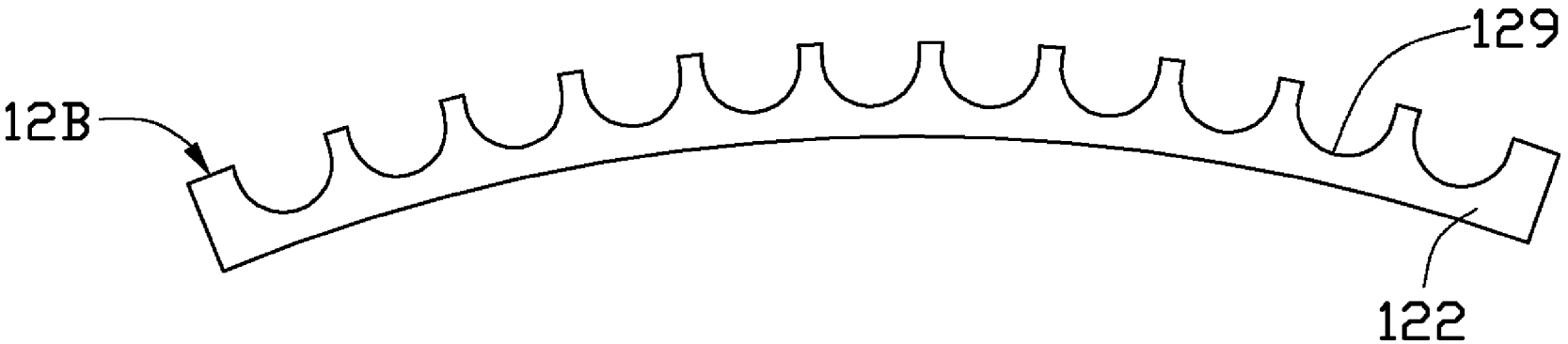
FIG. 8 is similar to FIG. 7, but showing the second light guiding region having hemicycle-shaped elongated grooves defined in an exterior surface thereof.
Figure 9:
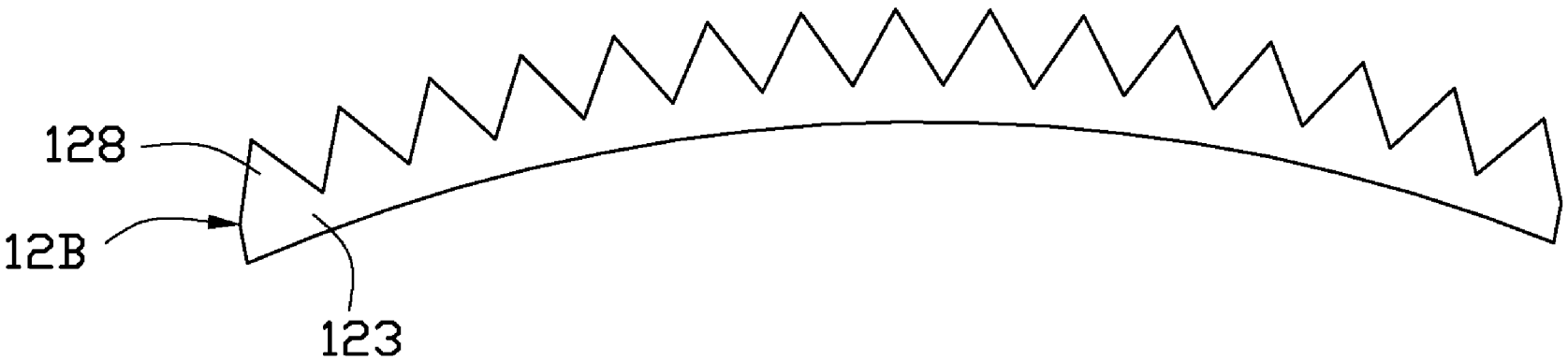
FIG. 9 is similar to FIG. 4, but showing the third light guiding region having V-shape elongated protrusions extending from an exterior surface thereof.

In alternative embodiments, the first region 121 may have a plurality of cylindrical elongated protrusion 128 extends outwardly from the exterior surface 12B thereof along the X-axis, with the interior surface 12A of the first region 121 being a smooth surface, as shown in FIG. 6. In addition, the second region 122 may have a plurality of hemicycle-shaped elongated grooves 129 defined therein. The hemicycle-shaped elongated grooves 129 may be defined in the interior surface 12A, and each hemicycle-shaped elongated groove 129 may extend parallel to the X-axis, as shown in FIG. 7. Alternatively, the hemicycle-shaped elongated grooves 129 may be defined in the exterior surface 12B, as shown in FIG. 8. Furthermore, the third region 123 may has a plurality of V-shape elongated protrusion 128 extends outwardly from the exterior surface 12B thereof along the X-axis, as shown in FIG. 9.

The illumination device 100 may further include a bracket 14 for holding the light source 11. The bracket 14, for example, may include a main body 140 having a second accommodating space 14A therein, and two supporting portions 142. In this embodiment, the main body 140 is in the form of a second cylinder having the second accommodating space 14A defined therein. The main body 140 has two opposite ends, at each of which the second accommodating space 14A is exposed to an exterior of the main body 140. The two supporting portions 142 extend from two opposite inner sides of the main body 140. Each of the two supporting portions 142 has an elongated groove 1420 defined therein, for fittingly receiving a corresponding side edge of the substrate 111. The bracket 14 can made of light-pervious material, such as resin, polymer or glass, etc.

The actuator 13 can be a motor with a central shaft (not visible). The shaft of the motor is coaxial with the X-axis of the light guiding barrel 12.

Figure 10:
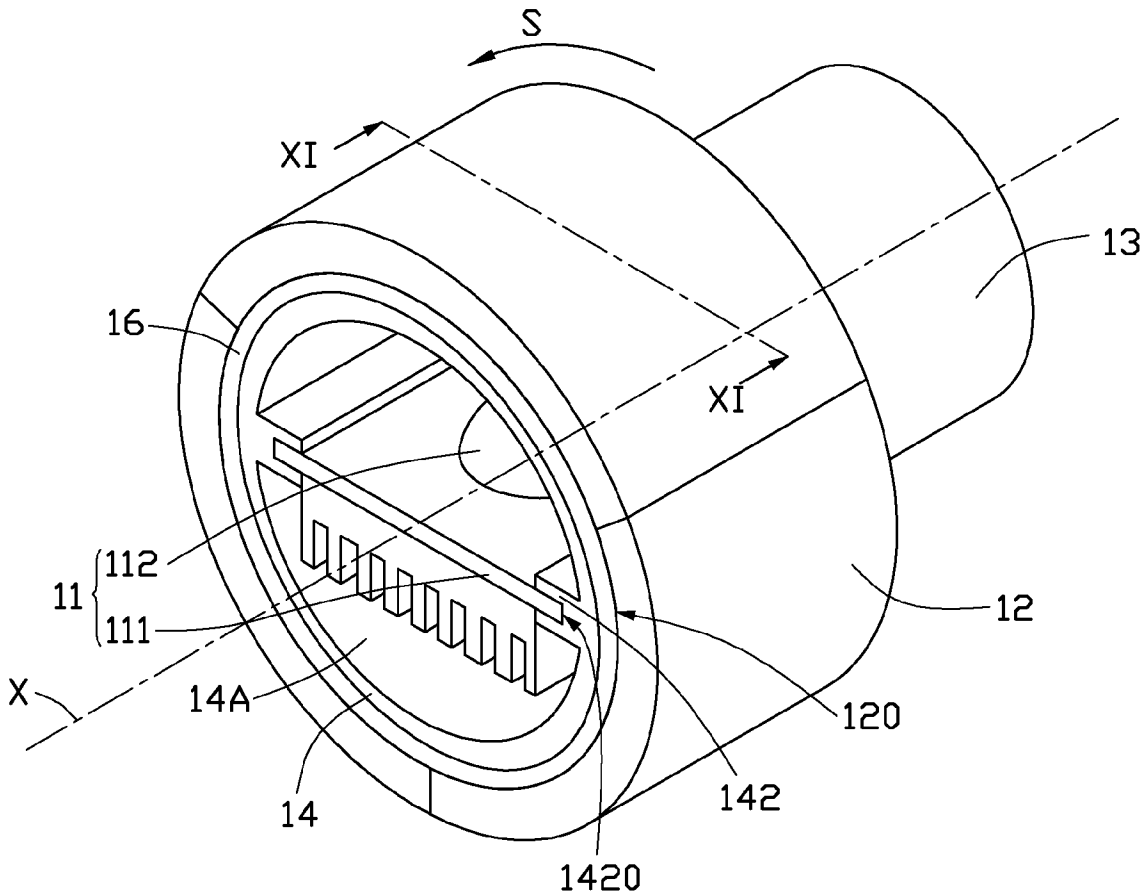
FIG. 10 is an assembled view of the illumination device of FIG. 1.
Figure 11:
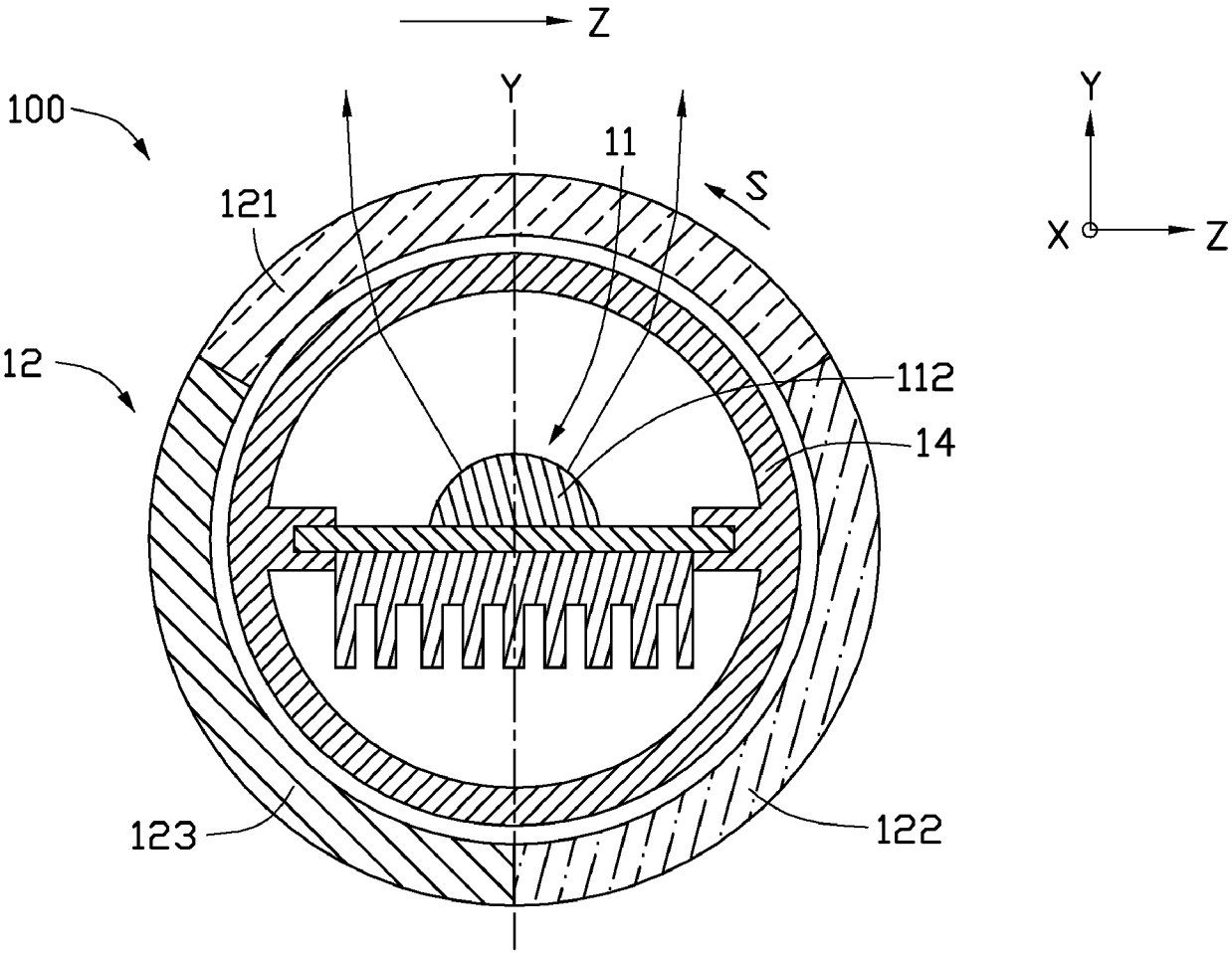
FIG. 11 is a cross section of the illumination device of FIG. 10, taken from line XI-XI thereof.

Referring also to FIGS. 10 and 11, in assembly, by sliding the opposite side edges of the substrate 111 into the two elongated grooves 1420 of the supporting portions 142, the light source 11 can be held by the bracket 14 in the second accommodating space 14A. Then the bracket 14, together with the light source 11 can be received in the first accommodating space 120 of the light guiding barrel 12, with the LED 112 positioned on, or adjacent to the X-axis of the light guiding barrel 12. In the illustrated embodiment, an imaginary center axis of the substrate 111 is coaxial with the X-axis. Accordingly, an imaginary diameter of a base surface of the LED 112 is near and parallel to the X-axis. In addition, the actuator 13 can be coupled to the second end 126 of the light guiding barrel 12, as shown in FIG. 10. Furthermore, two bearings 16 can be provided. The bearings 16 are mounted between the main body 140 and the light guiding barrel 12 at the first end 124 and the second end 126, respectively. Thereby, the bracket 14 is rotatably coupled to the light guiding barrel 12 through the bearings 16.

Figure 12:
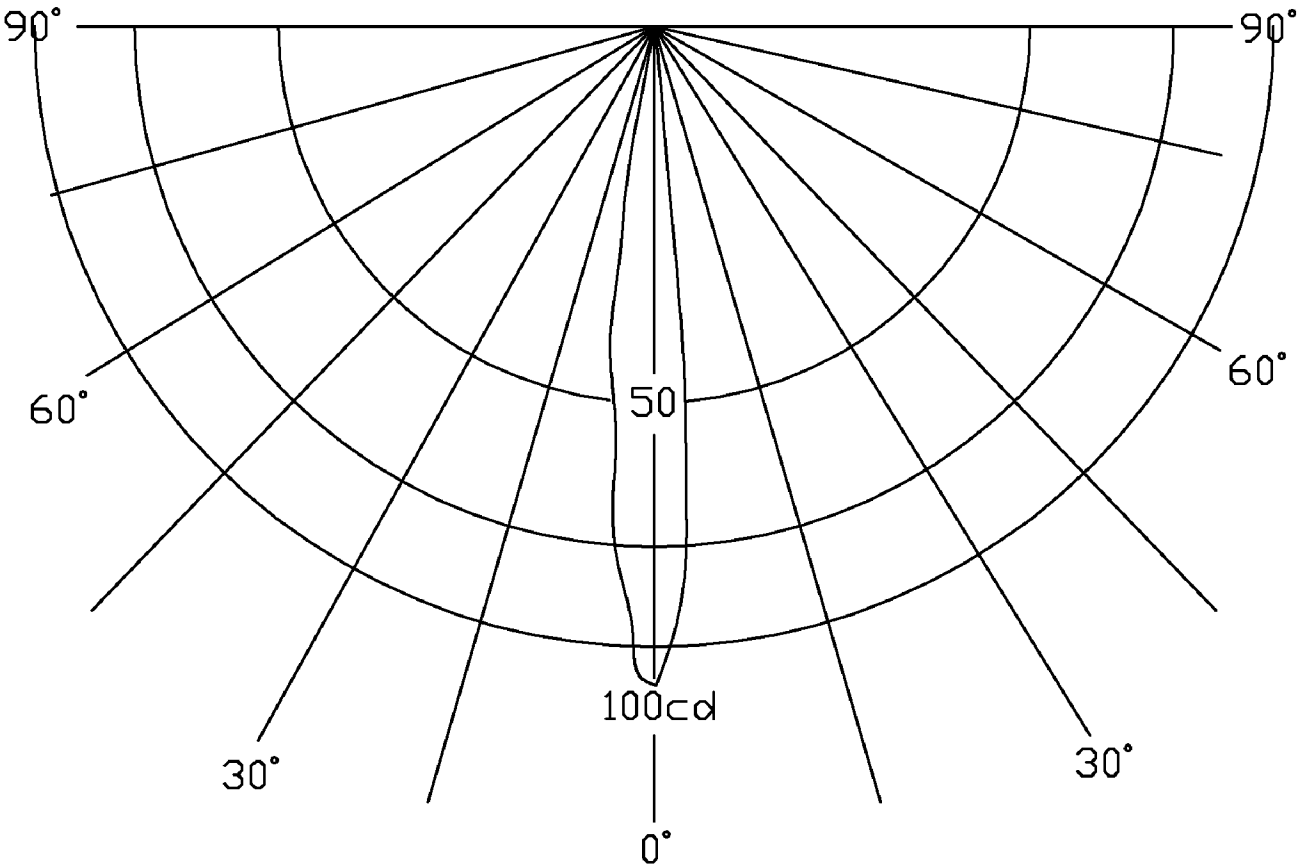
FIG. 12 is a diagram illustrating light intensity distribution of the light incident and output from a first light guiding region of FIG. 3.
Figure 13:
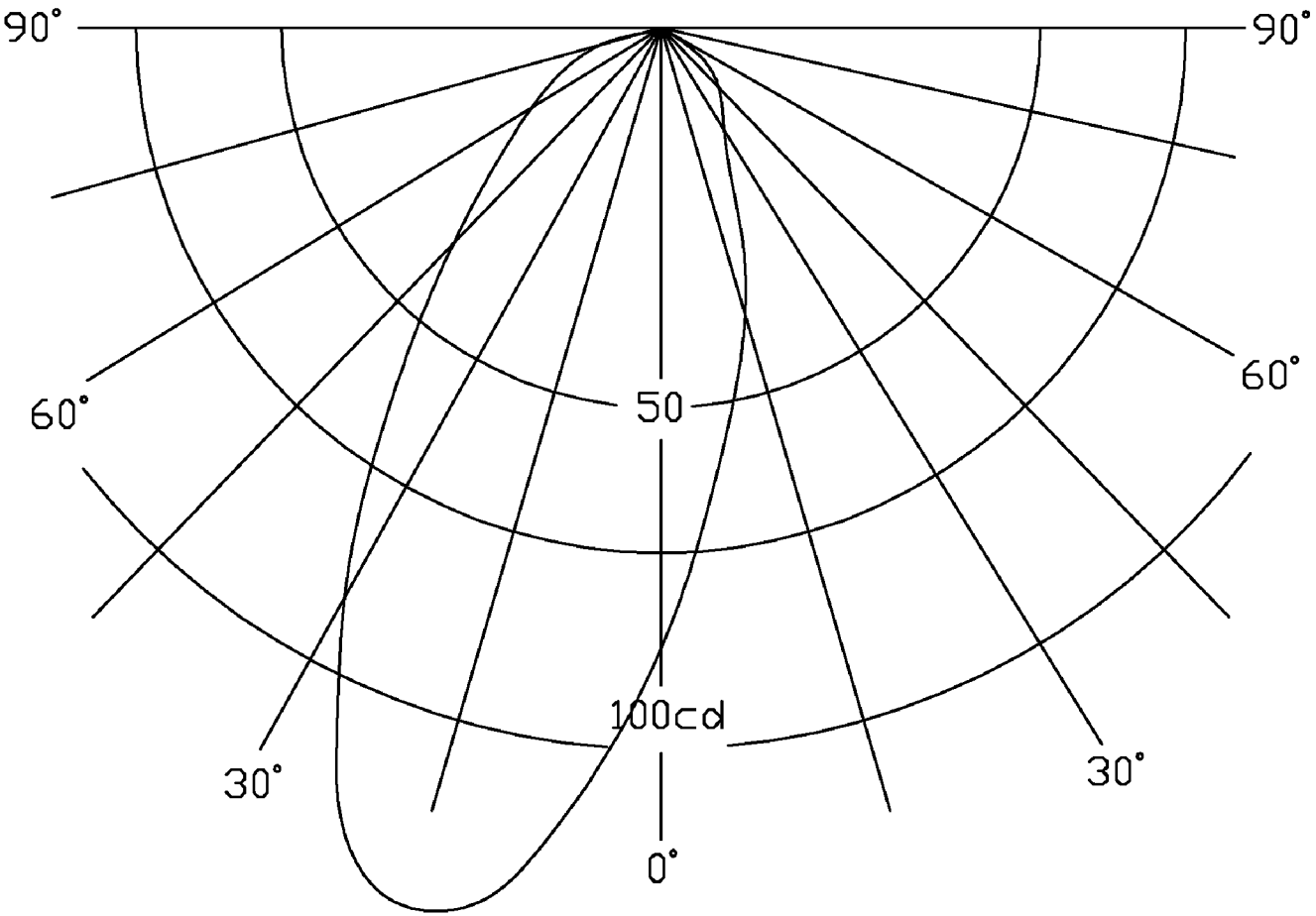
FIG. 13 is a diagram illustrating light intensity distribution of the light incident and output from a third light guiding region of FIG. 5.

Referring to FIG. 11, in a typical application, the bracket 14 with the light source 11 held thereon is fixed to another object (not shown). The actuator 13 rotates the light guiding barrel 12 counter-clockwise (as viewed in FIG. 11, shown by the arrow S). Thus, one or two of the light guiding region(s) 121, 122, 123 can be selectively arranged opposite to the LED 112. The selected light guiding regions 121, 122, 123 thereby receive the light emitted from the light source 11, and guide a direction of the light accordingly. In one example, as shown in FIG. 11, the first region 121 is rotated to face the LED 112. The light emitted from the LED 112 along a given light path substantially perpendicular to the X-axis passes through the cylindrical elongated protrusions 128 of the first region 121. The cylindrical elongated protrusions 128 decrease a radiating range of the light along Z-axis directions perpendicular to a XY-plane, the decrease being in positive and negative Z-axis directions. FIG. 12 shows light intensity distribution of the LED 112 after the light thereof passes through the first region 121. The FWHM of the LED 112 after the light passing through the first region 121 is about 13 degrees, which is much smaller than the FWHM of the LED 112 before the light passing through the first region 121 (120 degrees). In another example, the third region 123 is rotated to face the LED 112, the V-shape elongated protrusion 128 of the third region 123 improve an uniformity of the light emitted from the LED 112 when the transverse cross section of each V-shape elongated protrusion 128 is an isoceles triangle. Alternatively, the V-shape elongated protrusions 128 may redirect light generated from the LED 112 to deviate from the XY-plane along positive or negative Z-axis directions perpendicular to the XY-plane, when the transverse cross section of each V-shape elongated protrusion 128 is a right triangle. FIG. 13 shows light intensity distribution of the LED 112 after the light thereof passes through the third region 123.

Figure 14:
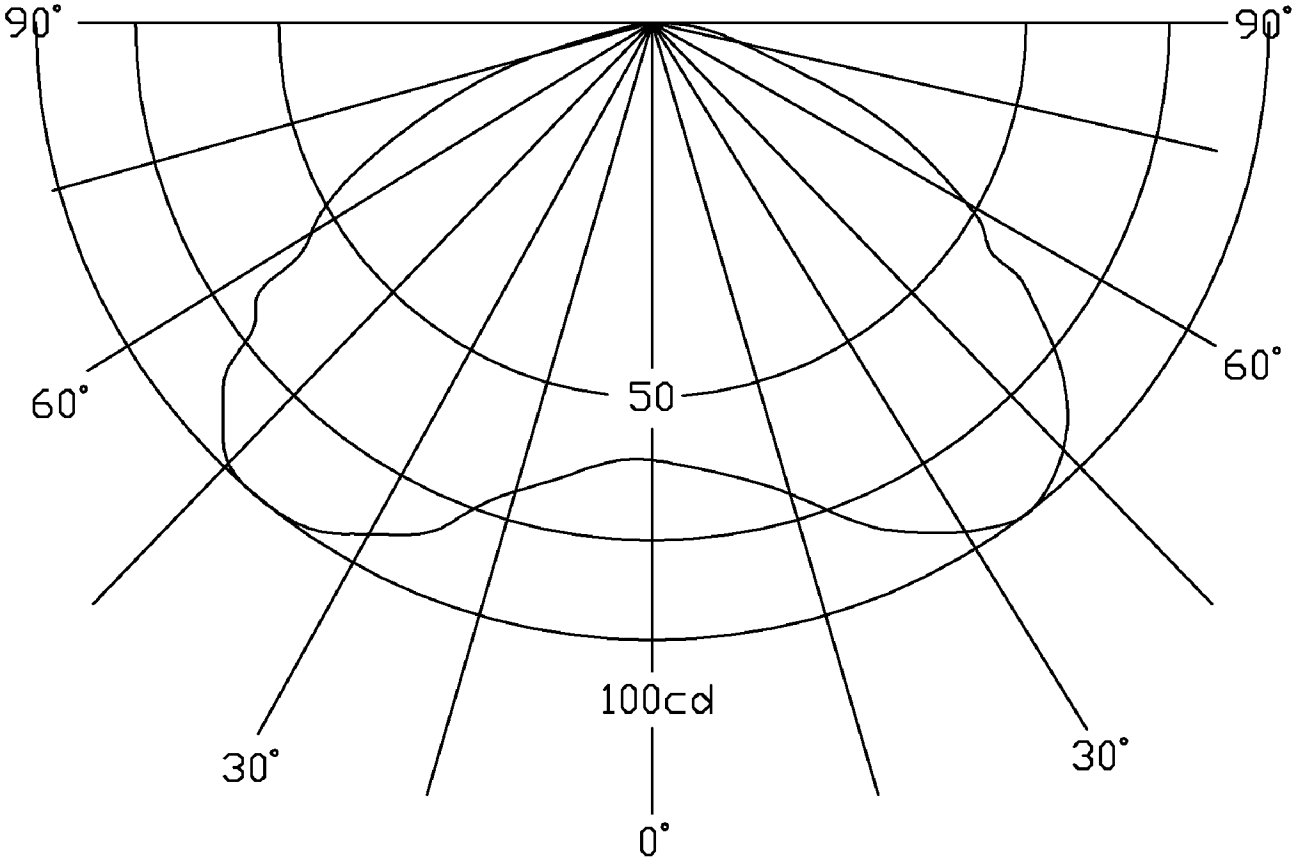
FIG. 14 is a diagram illustrating light intensity distribution of the light incident and output from a second light guiding region of FIG. 7.

In yet another example, the second region 122 is rotated to face the LED 112, the light emitted from the LED 112 along a given light path direction substantially perpendicular to the X-axis passes through the second region 122 with hemicycle-shaped elongated grooves 129 defined in the interior surface 12A thereof. The hemicycle-shaped elongated grooves 129 can increase a radiating range of the light along Z-axis directions perpendicular to the XY-plane, the increase being in positive and negative Z-axis directions. FIG. 14 shows light intensity distribution of the LED 112 after the light thereof passes through the second region 122. The FWHM of the LED 112 after the light passing through the second region 122 is about 127 degrees, which is larger than the FWHM of the LED 112 before the light passing through the second region 122 (120 degrees).

Therefore, the illumination device 100 may have a selective output light with different light intensity distributions. In one application, the illumination device 100, for example, may be used to provide overhead lighting when the second region 122 with hemicycle-shaped elongated grooves 129 defined therein is rotated to face the LED 112.

In alternative embodiments, the interior surface 12A and the exterior surface 12B of the second region 122 may both have hemicycle-shaped elongated grooves 129 defined therein. In such case, the hemicycle-shaped elongated grooves 129 defined in both the interior surface 12A and the exterior surface 12B of the second region 122 increase a larger radiating range of the light along Z-axis directions perpendicular to the XY-plane. In other alternative embodiments, the actuator 13 may be coupled to the bracket 14. Accordingly, in operation, the light guiding barrel 12 is fixed to an object (not shown), and the actuator 13 rotates the bracket 14 with the light source 11 held therein. The LED 112 can thus be selectively positioned opposite to one or two of the light guiding regions 121, 122, 123. In still other alternative embodiments, the illumination device 200 may include a plurality of LEDs 112 arranged along the X-axis of the light guiding barrel 12.

In summary, the illumination device 100 is equipped with light guiding barrels 12 having a plurality of light guiding regions, and each of the light guiding regions is rotatable relative to the light source 11, such that a selected one or two of the light guiding regions is positioned opposite to the light source 11. Thus the light intensity distributions of the illumination device 100 can be flexibly changed according to different requirements, thereby providing rich and colorful illuminating effects as desired.

It is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. An illumination device, comprising:

a light source configured for emitting light along a given light path; and a light-pervious light guiding barrel receiving the light source therein, the barrel comprising a plurality of light guiding regions with different light directing and reflecting capabilities, the barrel being rotatable relative to the light source such that each of the light guiding regions can be selectively placed on the light path to direct and reflect the light from the light source;

wherein the barrel is substantially a cylinder having an accommodating space defined therein, and a boundary between every adjacent the light guiding regions is substantially parallel to a central axial of the cylinder;

wherein the light source comprises a light emitting diode positioned at the central axis of the barrel, the light path being substantially perpendicular to the central axis; and wherein a cross section of each region is circular arc in shape with a subtended angle substantially equal to a light radiation angle of the light emitting diode.

2. The illumination device of claim 1, wherein the light source further comprises a circuit board with the light emitting diode mounted thereon.

3. The illumination device of claim 1, further comprising a light-pervious bracket holding the light source in the accommodating space.

4. The illumination device of claim 3, wherein the bracket is made of material selected from the group consisting of resin, polymer, and glass.

5. The illumination device of claim 3, further comprising an actuator structured and arranged for controlling relative rotation of the barrel and the bracket.

6. The illumination device of claim 5, wherein the actuator comprises a motor.

7. The illumination device of claim 3, wherein the bracket comprises a cylindrical main body and two supporting portions extending from two opposite inner sides of the main body, the main body received in the barrel, and the supporting portions holding the circuit board.

8. The illumination device of claim 7, further comprising two bearings mounted between the main body and the barrel at a first end and an opposing second end of the barrel, respectively, the bracket being rotatably coupled to the barrel through the bearings.

9. The illumination device of claim 1, wherein at least one of the light guiding regions has a plurality of micro-structures facing the light source.

10. The illumination device of claim 9, wherein the micro-structures are elongated micro-structures each parallel to the central axial of the barrel.

11. The illumination device of claim 9, wherein a cross section of each micro-structure taken in a plane perpendicular to the central axis of the barrel is one of triangle-shaped, cylinder-shaped, and hemicycle-shaped.

12. The illumination device of claim 11, wherein the triangle is selected from the group consisting of an isoceles triangle and a right triangle.

13. The illumination device of claim 1, wherein the barrel is made of material selected from the group consisting of resin, silicone, glass, polyethylene terephalate, polymethyl methacrylate, and polycarbonate.

14. An illumination device, comprising:

a light source configured for emitting light along a given light path;

a light-pervious light guiding barrel receiving the light source therein, the barrel comprising a plurality of light guiding regions with different light directing and reflecting capabilities, the barrel being rotatable relative to the light source such that each of the light guiding regions can be selectively placed on the light path to direct and reflect the light from the light source, wherein the barrel is substantially a cylinder having an accommodating space defined therein, and a boundary between every adjacent the light guiding regions is substantially parallel to a central axial of the cylinder; and a light-pervious bracket holding the light source in the accommodating space;

wherein the bracket comprises a cylindrical main body and two supporting portions extending from two opposite inner sides of the main body, the main body received in the barrel, and the supporting portions holding the circuit board.

15. The illumination device of claim 14, further comprising two bearings mounted between the main body and the barrel at a first end and an opposing second end of the barrel, respectively, the bracket being rotatably coupled to the barrel through the bearings.

16. An illumination device, comprising:

a light source configured for emitting light along a given light path; and a light-pervious light guiding barrel receiving the light source therein, the barrel comprising a plurality of light guiding regions with different light directing and reflecting capabilities, the barrel being rotatable relative to the light source such that each of the light guiding regions can be selectively placed on the light path to direct and reflect the light from the light source;

wherein at least one of the light guiding regions has a plurality of micro-structures facing the light source; and wherein a cross section of each micro-structure taken in a plane perpendicular to the central axis of the barrel is one of triangle-shaped, cylinder-shaped, and hemicycle-shaped.

17. The illumination device of claim 16, wherein the triangle is selected from the group consisting of an isoceles triangle and a right triangle.

* * * * *